United States Patent [19]

Kataishi et al.

[11] 4,407,225

[45] Oct. 4, 1983

[54] MORTAR TREATING APPARATUS

[75] Inventors: Takao Kataishi; Nobufumi Yokoi, both of Tokyo, Japan

[73] Assignee: Misawa Home Co., Ltd., Tokyo, Japan

[21] Appl. No.: 325,899

[22] Filed: Nov. 30, 1981

[30] Foreign Application Priority Data

Jul. 23, 1981 [JP] Japan ..... 56-115680

[51] Int. Cl.[3] ..... B05C 13/00

[52] U.S. Cl. ..... 118/425; 118/426; 118/500; 414/779

[58] Field of Search ..... 118/423, 425, 426, 500; 134/76, 77, 83; 414/756, 754, 779

[56] References Cited

U.S. PATENT DOCUMENTS 3,356,230 12/1967 Anderson ..... 414/779
4,027,803 6/1977 Kawasaki et al. ..... 414/754 X

FOREIGN PATENT DOCUMENTS 54-6269 1/1979 Japan ..... 414/756
284682 11/1971 U.S.S.R. ..... 118/423
613997 7/1978 U.S.S.R. ..... 414/763

*Primary Examiner*—John P. McIntosh
*Assistant Examiner*—Mary Beth Calligaris
*Attorney, Agent, or Firm*—Flynn, Thiel, Boutell & Tanis

[57] ABSTRACT

An apparatus for immersing a reinforcement frame for a concrete panel or the like into a mortar liquid comprises a mortar tank and a reinforcement-arranged frame immersing mechanism, the immersing mechanism including a first engaging portion for suspending the reinforcement frame in the vertical direction and a second engaging portion engageable with the lower end portion of the reinforcement frame being suspended in the vertical direction, whereby at least one of these first and second engaging portions is moved, so that the reinforcement frame can be transferred from the vertical state to the horizontal state to be immersed into the mortar tank.

5 Claims, 3 Drawing Figures

MORTAR TREATING APPARATUS

BACKGROUND OF THE INVENTION

1. Field of the Invention

The present invention relates to mortar treating apparatuses, and particularly to a mortar treating apparatus in which reinforcement frame, adapted to be used in a cellular concrete panel and the like, is immersed into mortar to obtain corrosion protection effects.

2. Description of the Prior Art

Concrete panels have been commonly used as a construction material. In recent years, there has been adopted cellular concrete panels in order to obtain advantages of both concrete and wood as the material quality of the concrete panel of the type as described, that is, one, while being a concrete panel, is further rendered light in weight and satisfactory in heat insulating property.

There has been proposed the following process as a process of producing a cellular concrete panel. Firstly, steel bars in coil form adapted for making a framework are combined together lengthwise and crosswise to form a metal screen, and the outer periphery of this metal screen consisting of the steel bars in coil form is fixed to a frame. The framework thus formed is degreased, rinsed and immersed in a mortar liquid so as to be corrosion-protected, thereafter, set in a mold, a slurry containing cement, an admixture, water and so forth is poured into this mold, the surface thereof is smoothed by means of a smoothing member, and temporarily cured for a certain period of time.

Upon completion of the temporary curing, the semi-finished product thus produced is removed from the mold. A plurality of such semi-finished products are put together and water-splashed in a pre-curing step, and thereafter, put into an autoclave where the semi-finished products are cured at high temperature and under high pressure. Upon completion of curing, the panels thus obtained are subjected to finish-coating and the like, and then, stocked as finished products.

In order to obtain the corrosion protection effects by immersing the reinforcement frame for the concrete panel into the mortar during the process of producing the concrete panels as described above, it is necessary to minimize the occurrence of foaming in the mortar as much as possible.

However, since, heretofore, the reinforcement frame has been lowered, in a vertically suspended state, into a mortar tank to be immersed therein in the conventional mortar treating apparatus, particularly with the mortar treating apparatuses for the large-size panels, which have been increased in number, the movement of the reinforcement frame in the mortar tank is very large in value, with the result that, a disadvantage has occurred that foaming easily occurs in the mortar. In order to control the occurrence of the foaming, the rate of travel of the reinforcement frame should be held down to a very low level, thus presenting a disadvantage of decreasing the operation efficiency during the process of producing the concrete panels, and moreover, the mortar is not uniformly adhered to the reinforcement frame.

SUMMARY OF THE INVENTION

The present invention has as its object the provision of a mortar treating apparatus capable of controlling the foaming in the mortar, being excellent in the workability and facilitating the uniform adhesion of the mortar to the reinforcement frame.

The present invention contemplates that a second engaging portion is engaged with the lower end portion of the reinforcement frame for the concrete panel, which frame vertically hung from a first engaging portion, at least one of the first and second engaging portions is moved to transfer the reinforcement frame from a vertical state to a horizontal state, where the reinforcement frame is immersed into a mortar tank, thereby enabling to achieve the abovedescribed object.

DETAILED DESCRIPTION OF THE PREFERRED EMBODIMENT

Figure 1:
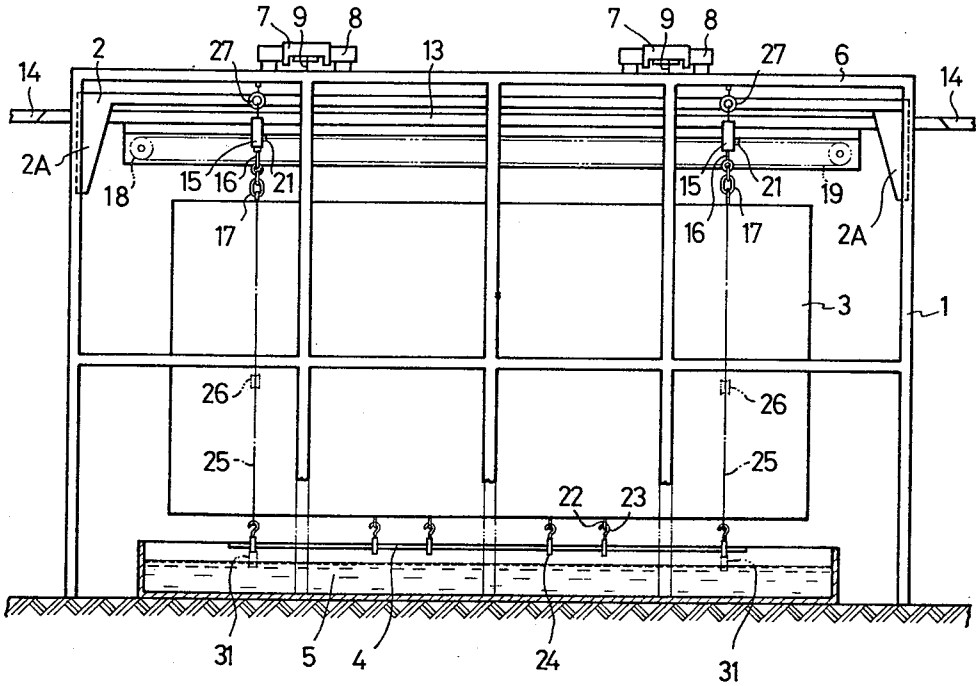
FIG. 1 is a partially sectional front view showing the general arrangement of the mortar treating apparatus according to the present invention.
Figure 2:
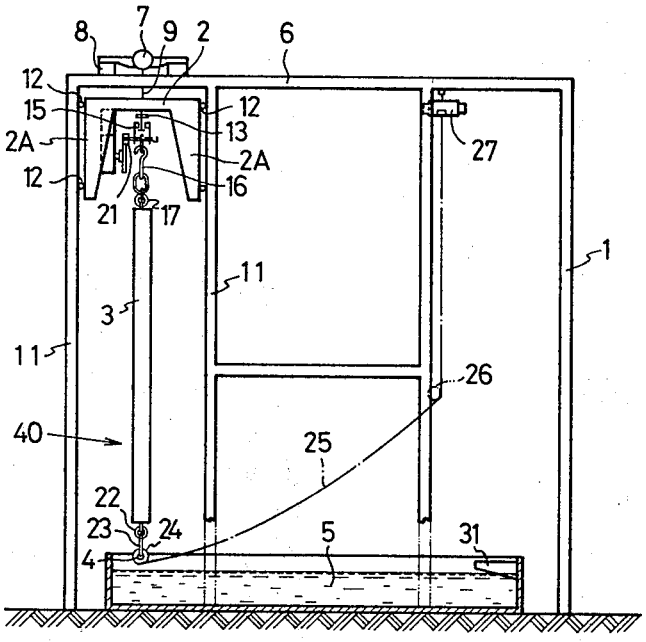
FIG. 2 is a partially sectional left side view of FIG. 1.

FIGS. 1 and 2 show the general arrangement of an embodiment of the present invention. In these drawings, a lifting frame 2 as a first engaging portion is vertically movably provided on a square frame 1, a reinforcement frame 3 for a concrete panel is vertically suspended from this lifting frame 2, and the suspended reinforcement frame 3 is engaged at the lower end thereof with a turn-over bar 4 as a second engaging portion. Furthermore, a mortar tank 5 is disposed at a predetermined position in a manner to be surrounded by the frame 1.

Chain blocks 7 are mounted through a chain block rack 8 at a predetermined position leftwardly of an upper frame portion 6 of the frame 1 in FIG. 2, and the aforesaid lifting frame 2 is suspended from this chain block 7 through lifting chains 9.

The lifting frame 2 is provided at opposite end portions thereof with legs 2A which are comparatively short and directed vertically downwardly, and guide rollers 12 are interposed between these legs 2A and rail frames 11 integrally formed on the frame 1 and extending perpendicularly thereto, whereby the lifting frame 2 is vertically movably guided by the rail frames 11.

A lifting rail 13 of a predetermined length is fixed on the lifting frame 2 in the longitudinal direction thereof and is arranged such that the lifting rail 13 can be connected to a track rail 14 at a position where it will be disposed, when the lifting frame 2 is pulled up to its upper-most position. Additionally, this track rail 14 is formed into a closed loop shape, not shown. The reinforcement frame 3, which has been firstly immersed into the mortar tank 5, is then transferred along the track rail 14, thereafter, immersed into the mortar tank 5 again, which operation is to be repeated a plurality of times.

Both the lifting rail 13 and the track rail 14 are formed into H-shape in cross section as viewed from sideways, and are adapted to rotatably guide pulley members 15. Connected to these pulley members 15 through hangers 16 are ring members 17 projectingly provided on the upper end edge of the reinforcement frame 3 in the drawings, whereby the reinforcement frame 3 is suspended from the lifting rail 13.

Furthermore, provided on the lifting frame 2 is an endless transfer chain 19 suitably driven by driving sprockets 18 (Refer to FIG. 1). The aforesaid pulley members 15 are suitably transferred to the left in FIG. 1 by means of chain dogs 21 provided on this transfer chain 19 at predetermined intervals.

Projectingly provided at the lower end edge, in the drawings, of the reinforcement frame 3 are a plurality of ring members 22, which are respectively connected to a plurality of disk-shaped franges 24 provided on the aforesaid turn-over bar 4 through hooks 23. Additionally, two of these flanges 24 disposed at opposite ends as shown in FIG. 1 are respectively connected thereto with turn-over chains 25, which are connected through guide pulleys 26 to turn-over chain blocks 27 provided at predetermined positions upwardly in the drawings. Furthermore, lifting frame 2, chain blocks 7, turn-over bar 4 and turn-over chain blocks 27 constitute a reinforcement frame immersing mechanism 40.

In addition, provided to the right, as viewed in FIG. 2, in the mortar tank 5 are abutting members 31, which are adaped to abut against the aforesaid flanges 24 when the reinforcement frame 3 is immersed into the mortar tank 5, to thereby prevent the reinforcement frame 3 from crashing against the mortar tank 5 and maintain the reinforcement frame 3 in a horizontal state in the mortar tank 5.

Description will now be given of action of this embodiment with reference to FIG. 3 as well.

Before the reinforcement frame 3 is placed in a predetermined state in the frame 1, the turn-over bar 4 is positioned vertically downwardly of the turn-over chain blocks 27 and suspended at positions not immersed in the mortar tank 5, or fixed to the frame 1 and so forth through hook-shaped fixing members and the like.

When the reinforcement frame 3 suspended from the pulley members 15 has been transferred from the track rail 14 to the right in FIG. 1 to reach a position shown in FIG. 1, the turn-over chains 25 are drawn out of the turn-over chain blocks 27 to move the turn-over bar 4 to position the same vertically downwardly of the reinforcement frame 3, and subsequently, the hooks 23 formed on the flanges 24 of the turn-over bar 4 are engaged with the ring members 22, respectively.

Figure 3:
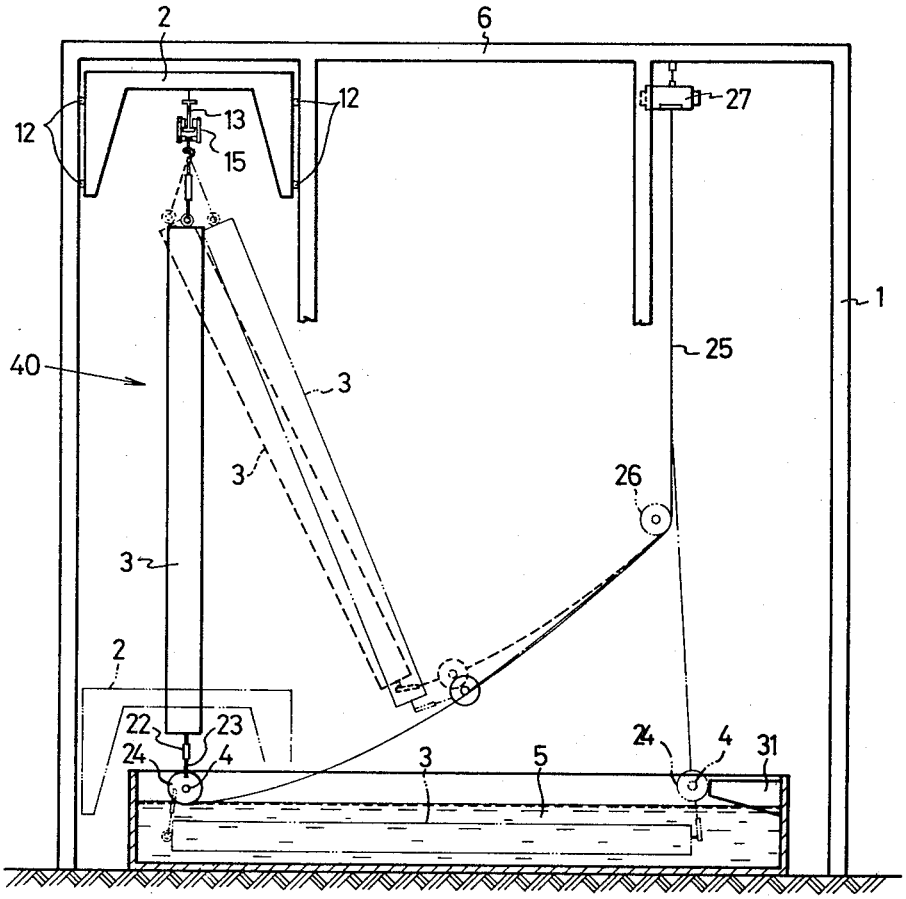
FIG. 3 is a view in explanation of operation of the abovedescribed embodiment.

When the turn-over chains 25 are wound up from the abovedescribed state, the reinforcement frame 3 is inclined in the countercloskwise direction as indicated by broken lines in FIG. 3. When the turn-over chains 25 are further wound up, the reinforcement frame 3 is transferred to the right in FIG. 3 while being inclined, as indicated by chain-dotted lines in FIG. 3.

When the turn-over chains 25 are stopped in windup in the abovedescribed state and the lifting frame 2 is progressively lowered, the lifting rail 13 and the transfer chain 19 is lowered in unison therewith. Consequently, the upper end edge of the reinforcement frame 3 is progressively lowered, while the lower end edge of the reinforcement frame 3 is transferred to the right in FIG. 3, and finally, the reinforcement frame 3 is immersed into the mortar tank 5 in a horizontal state. In addition, when the reinforcement frame 3 is immersed in the mortar tank 5 in a horizontal state, the flanges 24 of the turn-over bar 4 are abutted against the abutting members 31, so that the reinforcement frame 3 can be easily maintained in the horizontal state and can be quickly brought into a static state.

The reinforcement frame 3 thus immersed in the mortar tank 5 is subjected to the abovedescribed operation in the reverse order to be pulled up from the mortar tank 5, and the turn-over bar 4 is removed from the lower end edge of the reinforcement frame 3.

Thereafter, the reinforcement frame 3 is sent out to the outside of the frame 1 through the track rail 14 positioned to the left in FIG. 1, while a new reinforcement frame 3 is fed from the track rail 14 positioned to the right in the drawing. The reinforcement frame 3 thus sent out is to be fed from the track rail 14 positioned to the right in the drawing again in a predetermined period of time because the track rail 14 is of a closed loop shape. As described above, a predetermined number of the reinforcement frames 3 are to be successively immersed into the mortar a predetermined number of times.

The abovedescribed embodiment can offer the following advantages.

Since the reinforcement frame 3 is immersed in the mortar tank 5 in the horizontal state, the reinforcement frame 3 can be easily immersed totally. Consequently, the uniform adhesion of the mortar to the reinforcement frame 3 can be easily carried out, and the immersing can be decreased in the number of times, thereby enabling to improve the workability.

Further, the extent of the movement of the reinforcement frame 3 in the mortar tank 5 is low, whereby foams are prevented from occurring in the mortar, so that the corrosion protection effect through the mortar can be achieved at a very high efficiency.

Additionally, as compared with the case where the reinforcement frame 3 is immersed into the mortar tank 5 as in the vertical state, this embodiment can offer such an advantage as to be able to obtain a compact overall size in the treating apparatus.

Furthermore, in the abovedescribed embodiment, the lifting frame 2 as the first engaging portion and the turn-over bar 4 as the second engaging portion are moved together to bring the reinforcement frame 3 into the horizontal state, but on the contrary, one of the first and second engaging portions may be moved to bring the reinforcement-arranged frame 3 into the horizontal state.

In addition, in the abovedescribed embodiment, the turn-over chains 25 are engaged with the lower end edge of the reinforcement frame 3 through the turn-over bar 4, however, the turn-over bar 4 should not necessarily be indispensable, but, the turn-over chains 25 may be directly engaged with the reinforcement frame 3. Nevertheless, the provision of the turn-over bar 4 makes it possible to engage the turn-over chains 25 with the reinforcement frame 3 in a convenient manner, and such an advantage can, be offered that, even when the reinforcement frames 3 to be treated are different one from another, the turn-over chains 25 can be easily engaged with any types of the reinforcement frame 3.

As has been described hereinabove, the present invention can provide a mortar treating apparatus capable of controlling the foaming in the mortar, being excellent in the workability and facilitating the uniform adhesion of the mortar to the reinforcement frame.

What is claimed is:

1. A mortar treating apparatus comprising a mortar tank, an immersing mechanism disposed above said tank and adapted for immersing a reinforcement frame for a concrete panel into mortar contained in said tank, said immersing mechanism including a first engaging portion for suspending the reinforcement frame so that the reinforcement frame hangs vertically downwardly therefrom, and a second engaging portion engageable with the lower end portion of the reinforcement frame, and means for moving at least one of the first and second engaging portions to transfer the reinforcement frame from a vertical state to a horizontal state, wherein the reinforcement frame can be immersed into said tank.

2. A mortar treating apparatus as set forth in claim 1, wherein said first engaging portion comprises a vertically movable lifting frame for suspending the reinforcement frame in a vertical state, and said second engaging portion comprises a turn-over bar engageable with the lower end portion of the reinforcement frame.

3. A mortar treating apparatus as set forth in claim 2, wherein projecting ring members are provided at predetermined positions at opposite edge portions of the reinforcement frame, respectively, the reinforcement frame is engageable with said lifting frame and said turn-over bar through said ring members, and said lifting frame and said turn-over bar are not immersed into the mortar in said tank when the reinforcement frame is immersed in the mortar in said tank.

4. A mortar treating apparatus as set forth in claim 3, including a main frame having an upper frame portion and having integral rail frames extending vertically downwardly from said upper frame portion, said rail frames guiding and supporting said lifting frame for vertical movement, a lifting chain block mounted on said upper frame portion of said main frame, a lifting chain extending from said lifting chain block and connected to said lifting frame for effecting vertical movement thereof, turn-over chain blocks, turn-over chains extending from said turn-over chain blocks and connected to said turn-over bar so that said turn-over bar is pulled obliquely upwardly when said lifting frame is lowered, whereby said reinforcement frame is brought into a horizontal state.

5. A mortar treating apparatus as set forth in claim 4, wherein disk-shaped flanges are formed on said turn-over bar in the longitudinal direction thereof, said flanges being connected to ring members on one end edge of the reinforcement frame through hooks, and including abutment members provided at predetermined positions in said tank for abutting against said flanges when the reinforcement frame is immersed into the mortar in said tank in a horizontal state.

* * * * *